US005613147A

United States Patent [19]

Okamura et al.

[11] Patent Number: 5,613,147

[45] Date of Patent: Mar. 18, 1997

[54] SIGNAL PROCESSOR HAVING A DELAY RAM FOR GENERATING SOUND EFFECTS

[75] Inventors: Kazuhisa Okamura; Yoshio Fujita, both of Hamamatsu, Japan

[73] Assignee: Yamaha Corporation, Japan

[21] Appl. No.: 521,286

[22] Filed: Aug. 29, 1995

Related U.S. Application Data

[63] Continuation of Ser. No. 178,032, Jan. 6, 1994, abandoned.

[30] Foreign Application Priority Data

Jan. 8, 1993 [JP] Japan ..... 5-002130

[51] Int. Cl.[6] ..... G10H 7/00

[52] U.S. Cl. ..... 395/800; 84/602; 84/630; 381/63

[58] Field of Search ..... 395/800; 381/63; 84/601, 602, 630, 633

[56] References Cited

U.S. PATENT DOCUMENTS

| | | | |
|---|---|---|---|
| 4,384,504 | 5/1983 | Deforeit | 84/1.01 |
| 4,472,993 | 9/1984 | Futamase et al. . | |
| 4,803,731 | 2/1989 | Niimi et al. | 381/63 |
| 4,909,116 | 3/1990 | Tanaka et al. | 84/692 |
| 4,998,281 | 3/1991 | Sakata | 381/63 |
| 5,065,433 | 11/1991 | Ida et al. | 381/63 |
| 5,081,898 | 1/1992 | Fujimori | 84/622 |
| 5,136,912 | 8/1992 | Morikawa et al. | 84/603 |
| 5,241,129 | 8/1993 | Muto et al. | 84/625 |
| 5,243,123 | 9/1993 | Chaya | 84/609 |
| 5,247,130 | 9/1993 | Suzuki et al. | 84/622 |
| 5,254,804 | 10/1993 | Tamaki et al. | 84/626 |
| 5,276,845 | 1/1994 | Takayama | 395/425 |
| 5,283,387 | 1/1994 | Tanaka | 84/608 |
| 5,290,967 | 3/1994 | Shimaya | 84/633 |

*Primary Examiner*—Alyssa H. Bowler
*Assistant Examiner*—Walter D. Davis
*Attorney, Agent, or Firm*—Graham & James LLP

[57] ABSTRACT

A signal processor executes a plurality of microprograms to perform delaying processing and various arithmetic computation processings of digital signals input thereto. The signal processor has a storage area divided into a plurality of divided areas corresponding, respectively, to the microprograms. The write and read of the divided areas are controlled. When an instruction for changing at least one of the microprograms is given, the write and read of the digital signals are controlled such that at least one of the digital signals stored in at least one of the divided areas corresponds to the at least one microprogram is cleared without clearing the others of the digital signals stored in the others of the divided areas.

13 Claims, 7 Drawing Sheets

SIGNAL PROCESSOR HAVING A DELAY RAM FOR GENERATING SOUND EFFECTS

This is a continuation of application Ser. No. 08/178,032 filed on Jan. 6, 1994, now abandoned.

BACKGROUND OF THE INVENTION

1. Field of the Invention

This invention relates to a signal processor which is adapted to execute a plurality of microprograms to thereby perform delay processing and various numerical computation processings of digital signals input thereto.

2. Prior Art

Recently, there have been developed the technology of digital signal processors (DSP) which perform various numerical computation processings of digital signals input thereto, by executing a plurality of microprograms. Also, the art of manufacturing semiconductors has made progress, which has made DSPLSI's easily available.

Accordingly, some recent electronic musical instruments incorporate a DSPLSI (digital signal processor large-scale integrated circuit) which implements a sound effecter device formed by a plurality of effecter blocks each serving as sound effect-imparting means for imparting one kind of sound effect to a musical tone.

An electronic musical instrument of this type is provided with panel switches or the like which a player or operator selectively operates to set desired types of sound effect to the effecter blocks and to select connections between the effecter blocks.

The setting of desired types of sound effect and the selection of connections between the effecter blocks are carried out by a CPU (central processing unit) within the electronic musical instrument which sets or changes, according to manipulation of panel switches or the like by the player or operator, microprograms for carrying out sound effect imparting according to the types of sound effect and the connections between the effecter blocks, respectively, and then transfers the set or changed microprograms to the DSPLSI, which constitutes the sound effecter device, to be executed thereby.

However, the conventional DSPLSI described above is not capable of selectively changing individual microprograms. Therefore, even when some of microprograms are desired to be changed to change corresponding ones of a plurality of sound effects originally set for the effecter blocks, it is required to newly transfer all the microprograms including the changed microprograms to the DSPLSI.

Further, the above-mentioned sound effects include a modulation type for modulating a musical tone, such as distortion, and a reverberation type for reverberating a musical tone, such as reverberation. Both types require delaying digital musical tone data to impart effects of these types to musical tones, and an external delay RAM is generally used for this purpose.

The delay RAM used in an electronic musical instrument has a plurality of divided areas corresponding, respectively, to the effecter blocks, as shown in FIG. 1. More specifically, musical tone data are delayed for each effecter block by sequentially shifting the address of the delay RAM (random access memory) for the musical tone data from an address MAX to an address 0, and accordingly the borders between adjacent ones of the use areas assigned to the respective effecter blocks, which are put into use, also sequentially move as indicated by arrows in FIG. 1.

Therefore, when one microprogram for the DSPLSI is to be changed, e.g. in order to change a sound effect for one effecter block from chorus to distortion, all the areas of the delay RAM have to be cleared.

As a result, it takes a long time to clear the delay RAM. Further, during the clearing operation, it is impossible to generate musical tones.

SUMMARY OF THE INVENTION

It is the object of the invention to provide a signal processor which is capable of clearing only digital signals stored in areas of memory means corresponding to ones of a plurality of microprograms for executing delaying processing and various numerical computation processings of digital signals, which are to be changed.

To attain the above object, according to a first aspect of the invention, there is provided a signal processor for executing a plurality of microprograms to perform delaying processing and various arithmetic computation processings of digital signals input thereto.

The signal processor according to the first aspect of the invention is characterized by comprising:

memory means having a storage area thereof divided into a plurality of divided areas corresponding, respectively, to the microprograms;

address control means for controlling write and read of the digital signals into and from the divided areas of the memory means;

instructing means for giving an instruction for changing at least one of the microprograms; and control means responsive to the instruction from the instruction means, for controlling the address control means to clear at least one of the digital signals stored in at least one of the divided areas of the memory means corresponding to the at least one microprogram.

According to the signal processor of the present invention, when one microprogram of a plurality of microprograms to be executed by the signal processor is changed, only digital signals to be used by the microprogram to be changed, which are stored in a corresponding area of the memory means, can be cleared. Therefore, when this signal processor is applied to an electronic musical instrument, it is not required to clear digital signals in the areas corresponding to the microprograms other than one which should be changed, which makes it possible to clear the digital signals in a short time period with the other microprograms being permitted to be executed, so that duration of a musical tone is not interrupted.

Preferably, the signal processor includes cycle termination-detecting means for detecting termination of one cycle of execution of all the microprograms, and for generating a cycle termination signal when the termination of the one cycle is detected; a plurality of counting means provided, respectively, for the divided areas of the memory means, each of the counting means being for counting a number of addresses of a corresponding one of the divided areas from which a corresponding one of the digital signals is cleared; and memory use-permitting means for permitting use of the corresponding one divided area when the number of the addresses counted by the each counting means reaches a number corresponding to a size of the corresponding one divided area and at the same time the cycle termination signal is generated.

Further preferably, the address control means includes a plurality of clear signal-generating means provided, respectively, for the divided areas of the memory means, each of the clear signal-generating means being for generating a memory clear signal over a time period during which a corresponding one of the microprograms instructed to be changed by the instructing means is executed once.

Further preferably, the address control means includes data clear means responsive to the memory clear signal from the each clear signal-generating means, for writing data of a particular value into a selected address of one of the divided areas of the memory means corresponding to the corresponding one microprogram instructed to be changed by the instructing means.

Preferably, the signal processor includes second memory means storing the microprograms, starting address-designating means for designating starting addresses for the microprograms; and program-reading means for addressing the second memory means, based on the starting addresses designated by the starting address-designating means, for reading the microprograms from the second memory means.

According to a second aspect of the invention, there is provided a signal processor for selectively executing a plurality of microprograms to perform delaying processing and various arithmetic computation processings of digital signals input thereto.

The signal processor according to the second aspect of the invention is characterized by comprising:

memory means having a storage area thereof divided into a plurality of divided areas corresponding, respectively, to a maximum number of microprograms which are selectable from the plurality of microprograms;

address control means for controlling write and read of the digital signals into and from the divided areas of the memory means;

instructing means for selecting at least one of the maximum number of the microprograms, and for giving an instruction for changing the selected at least one microprogram; and control means responsive to the instruction from the instruction means, for controlling the address control means to clear at least one of the digital signals stored in at least one of the divided areas of the memory means corresponding to the selected at least one microprogram.

The above and other objects, features, and advantages of the invention will become more apparent from the following detailed description taken in conjunction with the accompanying drawings

BRIEF DESCRIPTION OF THE DRAWINGS

FIG. 3*a* to FIG. 3*i* collectively form a timing chart showing the relationship in timing between effecter blocks, a last step signal, effecter bank number signals, bank sizes, and memory banks of a delay RAM, in which:

FIG. 3*a* shows the effecter blocks;

FIG. 3*b* shows the last step signal LSTP;

FIG. 3*c* shows an effecter bank number signal EBN1;

FIG. 3*d* shows an effecter bank number signal EBN2;

FIG. 3*e* shows an effecter bank number signal EBN3;

FIG. 3*f* shows an effecter bank number signal EBN4;

FIG. 3*g* shows an effecter bank number signal EBN5;

FIG. 3*h* shows the bank sizes; and

FIG. 3*i* shows the memory banks of the delay RAM;

FIG. 7 is a timing chart showing the relationship in timing between signals used in the delaying address controller, in which:

DETAILED DESCRIPTION

The invention will be described in detail with reference to drawings showing an embodiment thereof.

Figure 2:
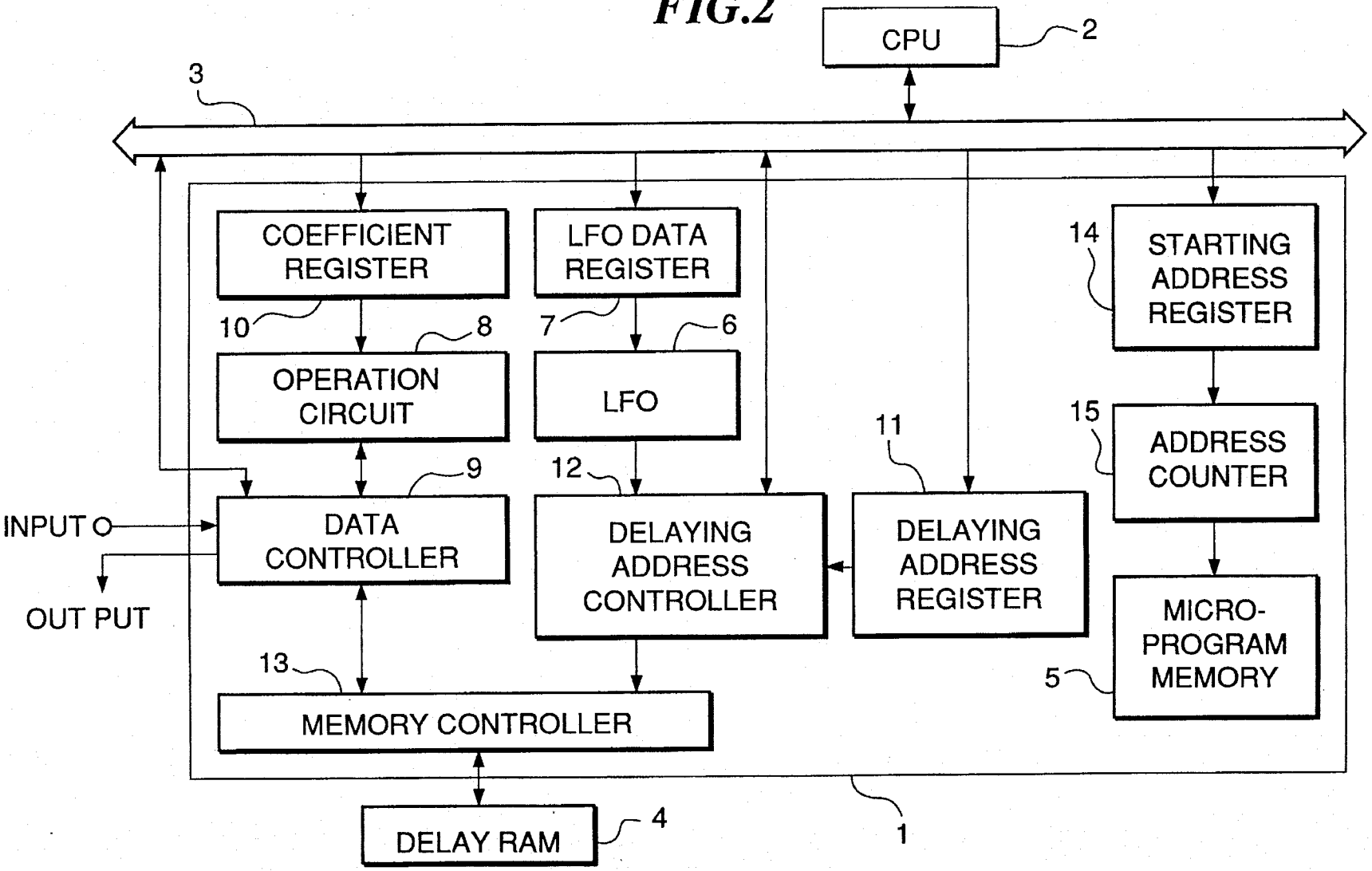
FIG. 2 is a schematic block diagram showing the whole arrangement of a signal processor according to an embodiment of the invention.

Referring first to FIG. 2, there is shown the whole arrangement of a sound effecter device to which is applied a signal processor according to the embodiment. In the figure, reference numeral 1 designates the signal processor. According to the present embodiment, the sound effecter device is incorporated in an electronic musical instrument, and imparts various sound effects, such as reverberation and chorus, to a plurality of musical tone data delivered from a tone generator, not shown. The electronic musical instrument includes, besides the sound effecter device 1 and the tone generator, a CPU (central processing unit) 2, a keyboard, a ROM (read only memory), a RAM (random access memory), a switch panel, a display, a sound system, none of which are shown, a CPU bus 3 through which the CPU 2 transfers and receives data to and from the sound effecter device 1 and the other component parts. Reference numeral 4 designates a delay RAM 4 externally attached to the sound effecter device 1, for delaying musical tone data input thereto by a predetermined time period, before delivering same therefrom.

The sound effecter device 1 is comprised of a microprogram memory 5 storing a plurality of microprograms for imparting respective sound effects to musical tones, a low frequency oscillator (LFO) 6 for generating low-frequency modulating signal data (data for changing delaying addresses and data for amplitude modulation) for controlling the modulation of musical tone data which is performed for imparting sound effects, such as vibrato and tremolo, to musical tones, and an LFO data register 7 for storing LFO data transferred from the CPU 2 via the CPU bus 3 for control of the LFO 6.

Reference numeral 8 designates an operation circuit for executing five microprograms supplied from the microprogram memory 5 to process musical tone data delivered from the tone generator of the electronic musical instrument via a data controller 9 for imparting respective sound effects to musical tones. The five microprograms are carried out on time shared basis at five effecter blocks EF1 to EF5, not appearing in the figure, respectively, based on coefficient data transferred from the CPU2 via the CPU bus 3 and a coefficient register 10 and amplitude-modulating data delivered from the LFO 6. The coefficient data are formed of coefficients for controlling effect balance of each sound effect and coefficients for filtering the musical tone data to impart sound effects, such as reverberation, to the musical tones. The term "effect balance" means a ratio of musical tone data (wet tone data) having a sound effect imparted thereto to a musical tone data (dry tone data) having no sound effect imparted thereto at which the musical tone data are added together.

Figures 3A, 3B, 3C, 3D, 3E, 3F, 3G, 3H, 3I:
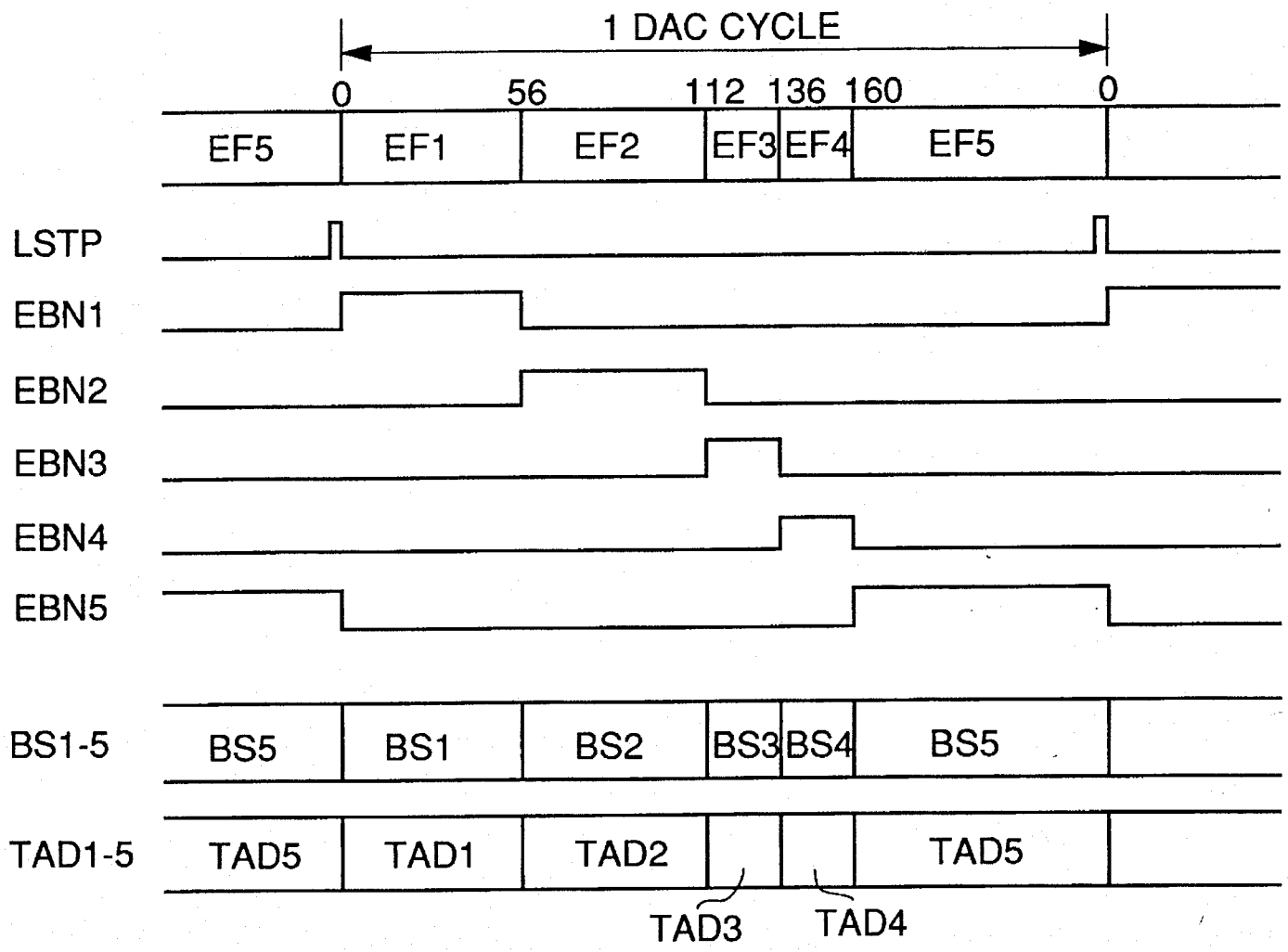

FIG. 3*a* shows an example of operating timing of the sound effecter device 1. In the present embodiment, one DAC cycle is formed of steps No. 0 to No. 255 (one step corresponding to an operation time period allowed for one Control code of a microprogram). As described above, the operation circuit 8 executes data processings for imparting the five sound effects at the respective effecter blocks EF1 to EF5 during one DAC cycle. The sizes of programs to be executed at the five effecter blocks EF1 to EF5 are fixed, with 56 steps for EF1, 56 steps for EF2, 24 steps for EF3, 24 steps for EF4, and 96 steps for EF5.

More specifically, as shown in FIG. 3*a*, during one DAC cycle, the steps No. 1 to No. 55 are carried out at the effecter block 1, the steps No. 56 to No. 111 at the effecter block EF2, the steps No. 112 to No. 135 at the effecter block EF3, the steps No. 136 to No. 159 at the effecter block EF4, and the steps No. 160 to No. 255 at the effecter block EFS, sequentially.

Referring again to FIG. 2, the data controller 9 controls input timing of musical tone data delivered from the tone generator of the electronic musical instrument, and output timing of musical tone data having an sound effect imparted at the operation circuit 8, as well as connections between the effecter blocks EF1 to EF5. Reference numeral 11 designates a delaying address register formed of 256 addresses, each of which stores delaying address data corresponding to an address in the delay RAM 4 transferred from the CPU 2 via the CPU bus 3.

The delaying address register 11, the LFO data register 7, and the coefficient register 10 each have addresses No. 0 to No. 255, and data stored in the respective addresses are read therefrom in a manner corresponding to the steps of operation of the operation circuit 8. The steps carried out at the operation circuit 8 correspond to the addresses of the registers such that the data at the address No. 1, for instance, is used at the step No. 1 of the operation circuit 8. To this end, the registers each have five divided areas corresponding respectively to the effecter blocks EF1 to EF5.

Reference numeral 12 designates a delaying address controller for controlling addresses of the delay RAM 4 into which musical tone data are to be written and addresses of same from which musical tone data are to be read, based on delaying address data stored in the delaying address register 11 and delaying address-changing data delivered from the LFO 6o Reference numeral 13 designates a memory controller for controlling the write and read of musical tone data into and from the delay RAM 4.

Figure 4:
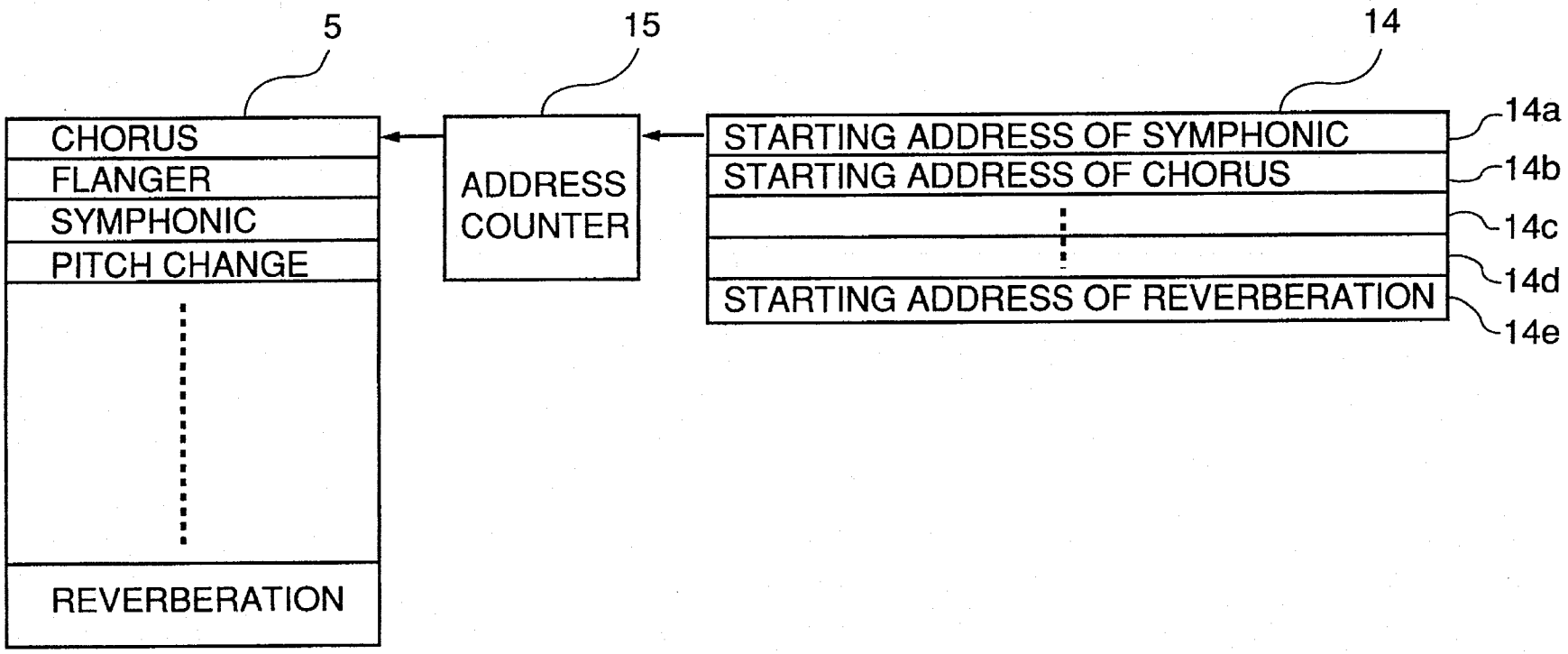
FIG. 4 is a diagram showing the relationship between a microprogram memory storing a plurality of microprograms, an address counter, and an starting address register.

In the present embodiment, the microprogram memory 5 stores eleven microprograms in total corresponding to respective sound effects, such as chorus, flanger, and symphonic, as shown in a left-hand block in FIG. 4. When the player or operator selects five sound effects out of the eleven sound effects, starting addresses of corresponding five microprograms in the microprogram memory 5 are transferred from the CPU 2 via the CPU bus 3 into register areas 14*a* to 14*e* of a starting address register 14, shown in a right-hand block in FIG. 4, which areas correspond respectively to the effecter blocks EF1 to EF5, for temporary storage therein. FIG. 4 illustrates an example in which a microprogram for symphonic is selected for the effecter block EF1 to be executed thereby, one for chorus for the effecter block EF2, . . . . , and one for reverberation for the effecter block EF5, and the starting addresses of the selected microprograms in the microprogram memory 5 are stored into the respective register areas 14*a* to 14*e* of the starting address register 14.

As stated hereinabove, the sizes of microprograms to be executed by the effecter blocks EF1 to EF5 are fixed, and hence the player or operator cannot select all the sound effects corresponding to all the eleven microprograms in the microprogram memory 5, but he can select several sound effects corresponding to microprograms having sizes suitable for respective effecter blocks.

Further, in FIG. 4, reference numeral 15 designates an address counter, which starts counting upon receiving a starting address of each of selected microprograms from the register areas 14*a* to 14*e* of the starting address register 14, and supplies a count value as address data to the microprogram memory 5, in response to which a corresponding microprogram is read from the microprogram memory 5 to the operation circuit 8. Therefore, in changing microprograms (i.e. sound effect), it is not required to transfer all the microprograms including a newly selected program to the signal processor, but by replacing a starting address of the old program by that of the newly selected one, the new set of microprograms can be put into use instantly.

Next, the outlined operation of the signal processor according to the present embodiment will be described. Musical tone data delivered from the tone generator to the sound effecter device 1 are delayed by the delay RAM 4 and processed by arithmetic computation according to selected microprograms by the operation circuit 8, to be thereby imparted with desired sound effects.

The delay RAM 4 has five divided memory banks $4_1$ to $4_5$ corresponding respectively to the effecter blocks EF1 to EF5, and boundaries between the effecter-blocks are fixed. More specifically, the starting addresses of the memory banks $4_1$ to $4_5$ are defined by fixed addresses TAD1 to TAD5 such that the memory bank 41 is defined by TAD1 (address No. 0) to TAD2–1, the memory bank $4_2$ by TAD2 to TAD3–1, the memory bank $4_3$ by TAD3 to TAD4–1, the memory bank $4_4$ by TAD4 to TAD5–1, and the memory bank $4_5$ by TAD5 to address MAX.

The maximum numbers of data that can be stored into the memory banks $4_1$ to $4_5$ of the delay RAM 4 correspond to the memory bank TAD2–TAD1, TAD3–TAD2, TAD4–TAD3, TAD5–TAD4, and the address MAX–TAD5+1, respectively.

For convenience of operation of the delaying address controller 12, in the present embodiment, values obtained by subtracting 1 from the maximum numbers of data that can be stored in the memory banks $4_1$ to $4_5$ are defined as bank sizes BS1 to BS5, respectively. That is, the bank sizes BS1 to BS5 are as follows: BS1=(TAD2–TAD1)–1, BS2=(TAD3–TAD2)–1, BS3=(TAD4–TAD3)–1, BS4=(TAD5–TAD4)–1, and BS5=address MAX–TAD5. Therefore, proper bank sizes BS1' to BS5' are equal to the bank sizes BS1 to BS5 plus 1, respectively.

The write of musical tone data into the delay RAM 4 is performed by writing musical tone data delivered from the data controller 9 into a write address designated by the delaying address controller 12, while the read of musical tone data therefrom is performed by reading musical tone data stored in a read address designated by the delaying address controller 12 into the data controller 9. As stated hereinabove, the write and read of tone data are controlled by the memory controller 13.

The delaying address controller 12 controls write addresses and read addresses for each of the effecter blocks EF1 to EF5, independently of each other. The write addresses are counted down from respective ending addresses of the memory banks $4_1$ to $4_5$ (e.g. the address TAD2–1 in the area $4_1$) whenever one DAC cycle is performed, to the starting addresses (e.g. the address TAD1 in the memory bank $4_1$), followed by returning to the respective ending addresses.

Figure 1:
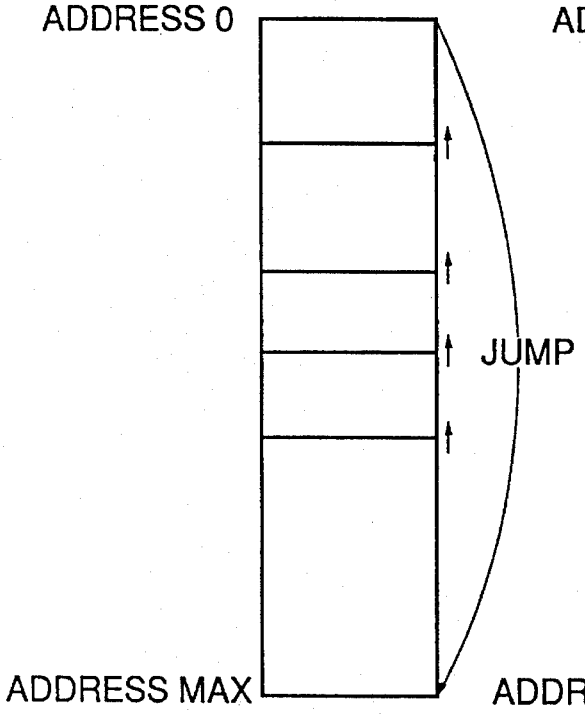
FIG.1 PRIOR ART
FIG. 1 is a diagram showing how a conventional delay RAM is used.
Figure 5:
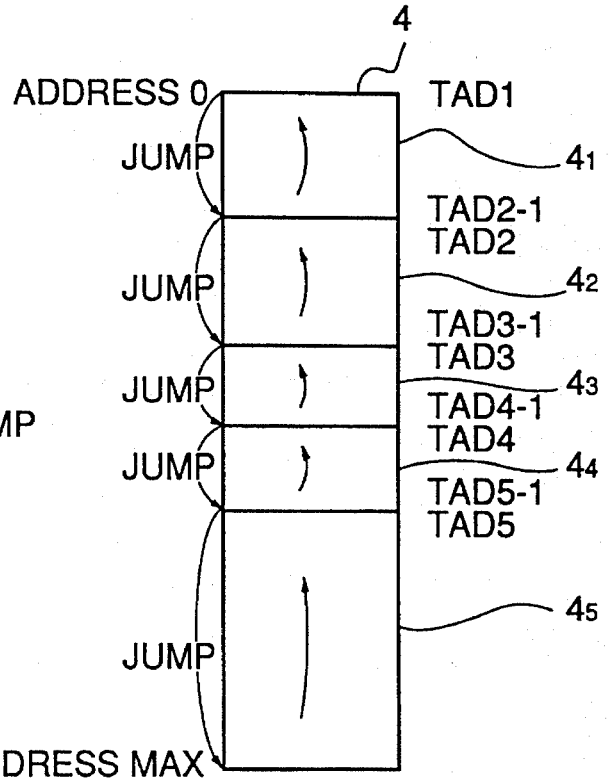
FIG. 5 is a diagram useful in explaining a manner of use of the delay RAM according to the embodiment.
Figure 6:
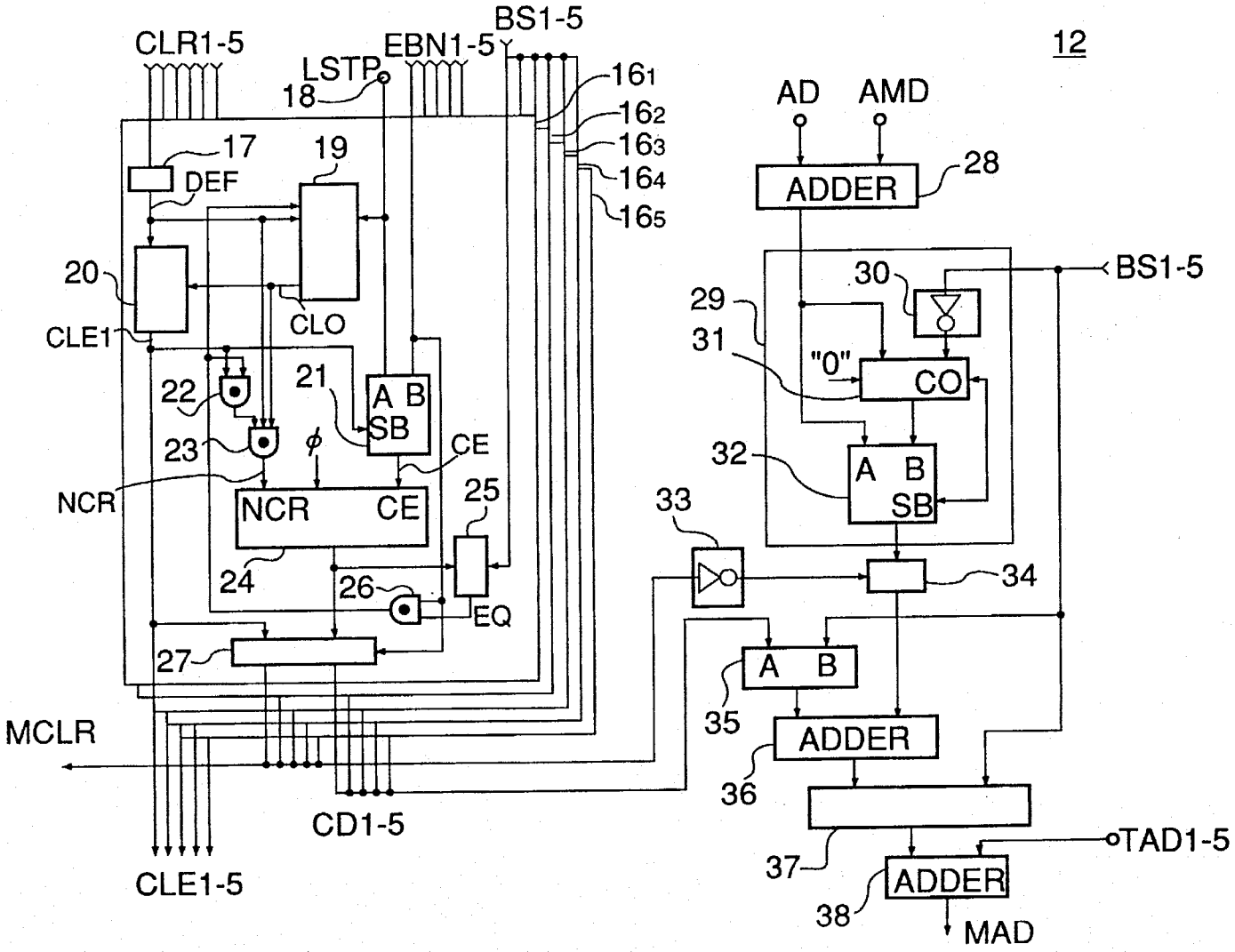
FIG. 6 is a circuit diagram showing the circuit configuration of a delaying address controller.

FIG. 6 shows the arrangement of the delaying address controller 12. In the figure, reference numerals $16_1$ to $16_5$ designate memory bank address counters corresponding, respectively, to the effecter blocks EF1 to EF5 each of which serves as an address counter in the normal mode thereof, and provides addresses of a memory bank to be cleared in the memory clear mode. It generates a memory clear signal MCLR for clearing data stored in the memory banks $4_1$ to $4_5$ (see FIG. 5) of the delay RAM 4 corresponding to the effecter blocks EF1 to EF5.

Figures 7A, 7B, 7C, 7D, 7E, 7F, 7G, 7H, 7I, 7J:
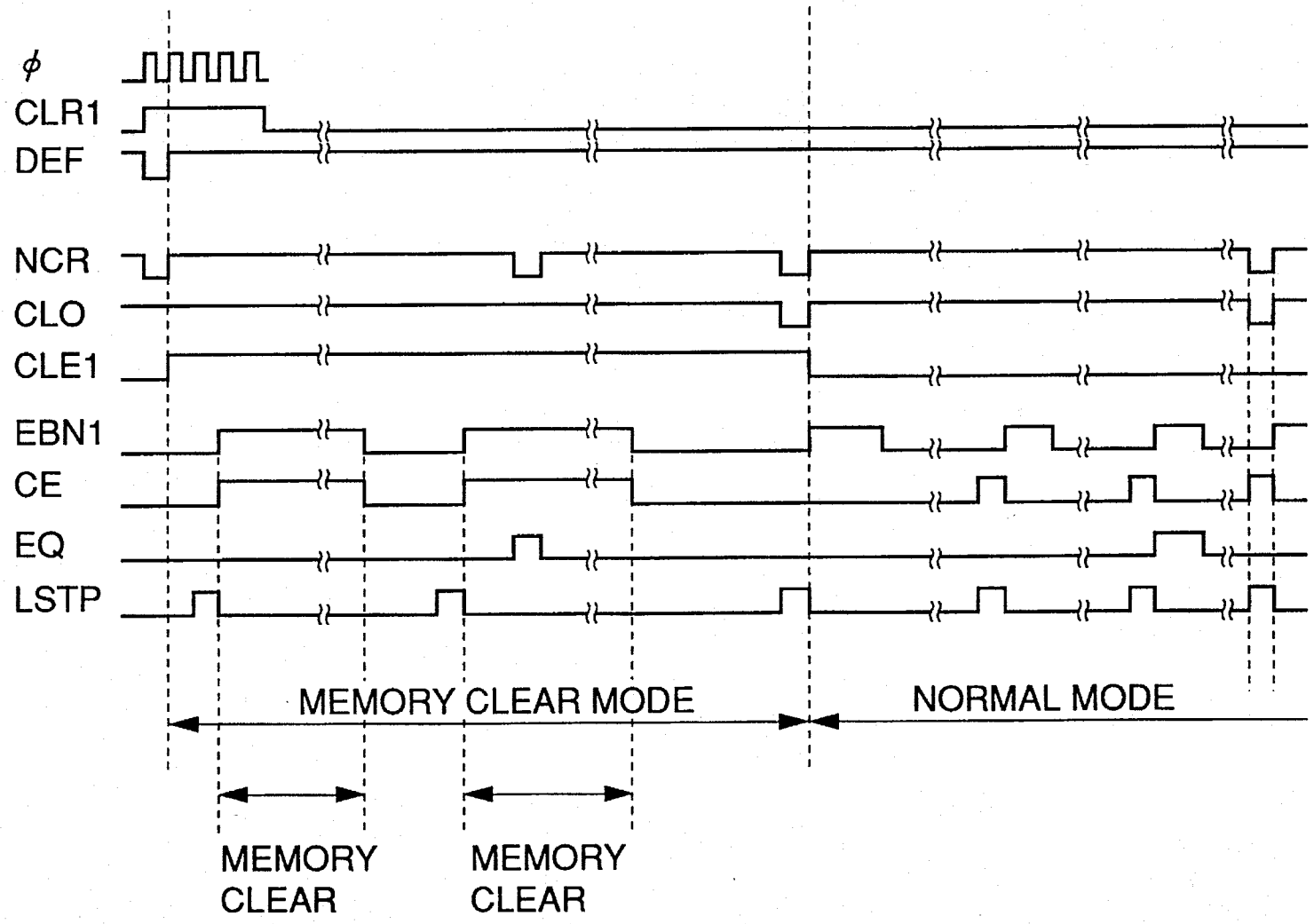
FIG. 7*a* shows a clock.
FIG. 7*b* shows a memory clear command CLR1.
FIG. 7*c* shows a differential signal DEF.
FIG. 7*d* shows a negative clear signal NCR.
FIG. 7*e* shows a clear signal CLO.
FIG. 7*f* shows a clear enable signal CLE1
FIG 7*g* shows an effecter bank number signal EBN1.
FIG. 7*h* shows a counter enable signal CE.
FIG. 7*i* shows an equality signal EQ.
FIG. 7*j* shows the last step signal LSTP.

The memory bank address counter $16_1$ includes a differentiating circuit 17 for differentiating a memory clear command signal CLR1 shown in FIG. 7*b* into a differential signal DEF having a negative logic, shown in FIG. 7*c*, and an input terminal 18 through which is delivered a last step signal LSTP (shown in FIG. 3*b* and FIG. 7*j*) from the CPU 2 via the CPU bus 3, which is set to a logical state "1" only when the step No. 255, i.e. the final step of one DAC cycle, is carried out at the operation circuit 8.

Reference numeral 19 designates a clear circuit which is responsive to the differential signal DEF, the last step signal LSTP, and an output signal from an AND gate 26, referred to hereinafter, for generating a clear signal CLO having a negative logic in synchronism with rise of the last step signal LSTP input after the output signal from the AND gate 26 is input thereto. Reference numeral 20 designates a memory clear mode register for generating a clear enable signal CLE1 set to a logical state "1" in synchronism with rise of the differential signal DEF and the clear enable signal CLE1 (see FIG. 7*f*) set to a logical state "0" in synchronism with rise of the clear signal CLO.

Reference numeral 21 designates a selector which has an input terminal A for receiving the last step signal LSTP, and an input terminal B for receiving an effecter bank number signal EBN1 (see FIG. 3*c* and FIG. 7*g*) from the CPU 2 via the CPU bus 3, which is set to a logical state "1" over a time period during which processing is performed at the effecter block EF1 within one DAC cycle, i.e. while the steps No. 1 to No. 55 are carried out. The selector 21 operates to select the effecter bank number signal EBN1 when the clear enable signal CLE1 is set to the logical state "1" and select the last step signal LSTP when the clear enable signal CLE1 is set to the logical state "0", to deliver a counter enable signal CE (see FIG. 7*h*) for enabling the counting operation by a counter 24, referred to hereinafter.

Reference numeral 22 designates a NAND gate having a first input terminal for receiving the clear enable signal CLE1, and a second input terminal for receiving the output signal from the AND gate 26. Reference numeral 23 designates an AND gate having a first input terminal for receiving an output signal from the NAND gate 22, a second input terminal for receiving the differential signal DEF, and a third input terminal for receiving the clear signal CLO from the clear circuit 19, to deliver a negative clear signal NCR (see FIG. 7d).

The counter 24 counts relative addresses of the memory bank $4_1$ (see FIG. 5) of the delay RAM 4 corresponding to the effecter block EF1 whenever a clock pulse $\phi$ having a repetition period corresponding to one step carried out by the operation circuit 8 is input thereto. The counter 24 is enabled by the counter enable signal CE and clears its count value when the negative clear signal NCR is input thereto.

Reference numeral 25 designates a comparator for comparing the count value of the counter 24 input through its first input terminal with the aforementioned bank size BS1 input through its second input terminal, to generate an equality signal EQ (see FIG. 7*i*) when these values become equal to each other. The bank size BS1 is continuously input to the comparator 25 only while the processing is carried out at the effecter block EF1 within one DAC cycle, i.e. over a time period during which the steps No. 0 to No. 55 are carried out. This is similarly the case with the other bank sizes BS2 to BS5.

The AND gate 26 has a first input terminal for receiving the effecter bank number signal EBN1, and a second input terminal for receiving the equality signal EQ. Reference numeral 27 designates a three-state buffer supplied with the clear enable signal CLE1 and the count value of the counter 24. The three-state buffer can be selectively set to three states, i.e. a logical state "1", a logical state "0" and a high impedance state. In this connection, an output signal corresponding to the clear enable signal CLE1 is delivered therefrom as the memory clear signal MCLR, while the count value of the counter 24 is delivered as count data CD1. The three-state buffer 27 is brought into the high-impedance state when the effecter bank number signal EBN1 is not input thereto, whereby the memory clear signal MCLR and the count data CD1 are delivered from the three-state buffer 27 only while the effecter bank number signal EBN1 is input thereto (i.e. over the time period corresponding to the steps No. 0 to No. 55). The memory bank address counters $16_2$ to $16_5$ are identical to the memory bank address counter $16_1$ both in arrangement and function, and therefore detailed description thereof is omitted.

In FIG. 6, reference numeral 28 designates an adder for adding together delaying address data AD delivered from the delaying address register 11 shown in FIG. 2, and delaying address-changing data AMD delivered from the LFO 6 shown in FIG. 2, and 29 a remainder calculator for calculating the remainder of subtraction of the bank sizes BS1 to BS5 from the output data from the adder 28.

The remainder calculator 29 includes an inverter 30 for inverting bits of the bank sizes BS1 to BS5, and an adder 31 having a carry data input terminal CI through which is supplied "0", which adds together output data from the adder 28 and output data from the inverter 30. The inverter 30 and the adder 31 form a subtracter for subtracting each of the bank sizes BS1 to BS5 from the output data from the adder 28. In its proper form, the carry data input terminal CI should be supplied with "1" in order to put the bank sizes BS1 to BS5 into two's-complement form. However, in the present embodiment, the bank sizes BS1 to BS5 are set to values which are smaller than correspondent proper bank sizes BS1' to BS5' by 1, and hence by applying "0" to the carry data input terminal CI, the results of calculation are equal to results of calculation using the proper bank sizes and the carry data of "1" Reference numeral 32 designates a selector having an input terminal A for receiving the output data from the adder 28 and, an input terminal B for receiving the output data from the adder 31, to select and deliver the output data from the adder 31 when it is supplied with carry data of "1" from a carry data output terminal CO of the adder 31, and select and deliver the output data from the adder 28 when it is not supplied with the carry data of "1".

Thus, the remainder calculator 29 delivers the output data from the adder 28 as it is when the output data from the adder 28 is smaller than the value of a corresponding one of the proper bank sizes BS1' to BS5', whereas it delivers the output data from the adder 31 when the output data from the adder 28 is equal to or larger than the value of the corresponding proper bank size BS1' to BS5'.

In the present embodiment, when musical tone data are processed at the effecter blocks EF1 to EF5, musical tone data to be delayed is written into the delay RAM 4 by addressing the corresponding memory banks $4_1$ to $4_5$ thereof while sequentially shifting a write address of each of the corresponding memory banks $4_1$ to $4_5$ into which the musical tone data is written, from the ending address to the starting address. When the starting address is reached, the write address is jumped back to the ending address, and then sequentially shifted toward the starting address again, as shown in FIG. 5o Further, when any sound effect to be created by one of the effecter blocks EF1 to EF5 is changed and accordingly a corresponding one of the memory banks $4_1$ to $4_5$ of the delay RAM 4 is to be cleared as well, an address to be cleared is shifted in the same manner as described above with respect to writing of musical tone data therein. The remainder calculator 29 and another remainder calculator 37, referred to hereinafter, are provided for executing the change of addresses described above.

Reference numeral 33 designates an inverter for inverting the memory clear signal MCLR, 34 a gate for allowing output data from the remainder calculator 29 to pass therethrough when output data from the inverter 33 is in a logical state "1", i.e. when the memory clear signal MCLR is in the logical state "0" (normal mode), and 35 a subtracter for subtracting count data CD1 to CD5 input through its input terminal A from the respective bank sizes BS1 to BS5 input through its input terminal B.

Reference numeral 36 represents an adder for adding up output data from the subtracter 35 and output data from the gate 34, and 37 the aforementioned remainder calculator having the same construction and function as the remainder calculator 29. Reference numeral 38 represents an adder for adding up output data from the remainder calculator 37 and one of starting address data TAD1 to TAD5 delivered from a starting address register (five stage type), not shown, for the delay RAM 4 only during a time period over which are executed the whole steps of a microprogram selected for one of the effecter blocks EF1 to EF5, and delivering results of the addition as modified address data MAD to the delay RAM 4 at an address terminal ADS thereof.

As stated before, the delay RAM4 has five divided memory banks corresponding, respectively, to the effecter blocks EF1 to EF5 to be used therefor, and starting address data TAD1 to TAD5 of respective memory banks $4_1$ to $4_5$ are stored in advance in the starting address register for the delay RAM 4.

Figure 8:
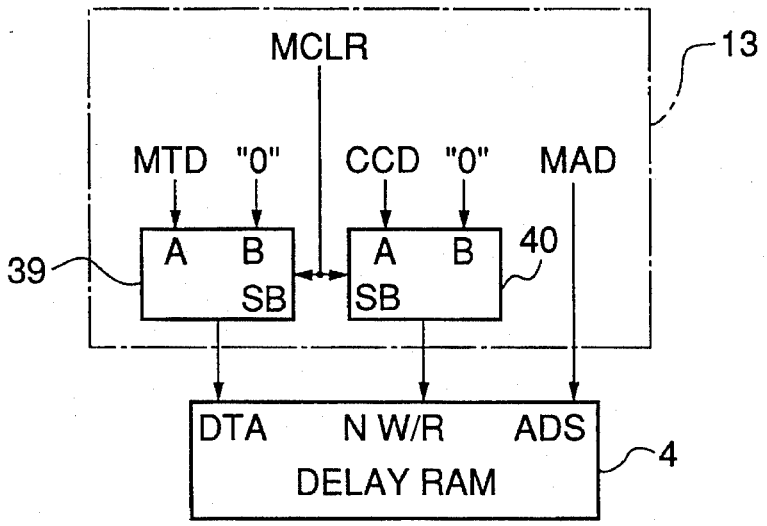
FIG. 8 shows the interior construction of a memory controller 13.

Next, FIG. 8 shows the construction of the memory controller 13 appearing in FIG. 2. In the figure, reference numeral 39 designates a selector having an input terminal A through which is supplied musical tone data MTD delivered from the data controller 9, an input terminal B through which is supplied data of "0", whereby when the memory clear signal MCLR is in the logical state "1", the data of "0" is selected and supplied to the delay RAM 4 through a data input terminal DATA thereof. Reference numeral 40 designates a selector having an input terminal A through which is supplied a control code CCD constituting a microprogram, and an input terminal B through which is supplied data of "0", whereby when the memory clear signal MCLR is in the logical state the data of "0" is selected, i.e. the write of data is selected to supply same to the delay RAM 4 through a write/read control terminal NW/R thereof.

Further, as stated above, the modified address data MAD from the delaying address controller 12 is supplied to the delay RAM 4 through the address terminal ADS thereof, whereby when the memory clear signal MCLR is in the logical state "1", the data in the address indicated by the modified address data MAD is cleared.

Figure 9:
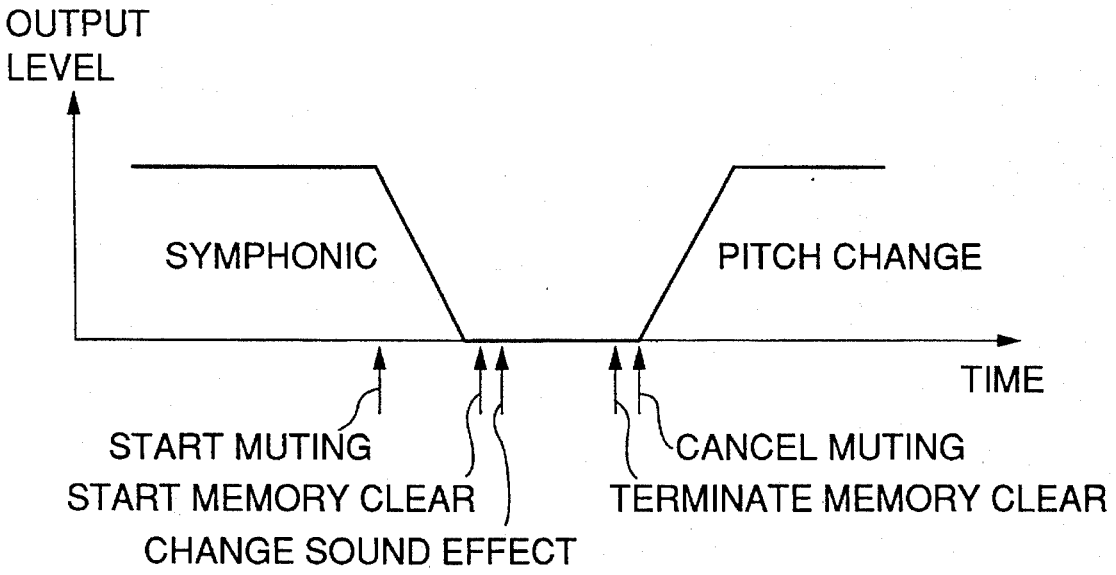
FIG. 9 shows a sequence of operations performed in replacing one sound effect by another.

Next, description will be made of the operation of the signal processor, for example, in the case where the sound effect assigned to the effecter block EF1 is changed, e.g. from symphonic to pitch change, as shown in FIG. 9. When the player or operator manipulates a switch or the like, not shown, of the switch panel to give an instruction that the type of sound effect assigned to the effecter block EF1 should be changed from symphonic to pitch change, the CPU 2 of the electronic musical instrument first delivers an instruction to the data controller 9 to mute the output level of the effecter block EF1, whereupon the data controller 9 progressively decreases the output level of the effecter block EF1 as shown in FIG. 9.

When the output level of the effecter block EF1 has been decreased to a zero level, the CPU 2 transfers the memory clear signal CLR1 corresponding to the effecter block EF1 to the delaying address controller 12 via the CPU bus 3, and then starts a sound effect-changing operation. More specifically, the starting address for symphonic address written in the register area 14*a* of the starting address register 14 appearing in FIG. 4 is changed to a starting address for pitch change, and at the same time, LFO data, coefficient data, and delaying address data for pitch change are written into respective areas of the LFO data register 7, the coefficient register 10, and the delay address register 11 corresponding to the effecter block EF1.

On the other hand, upon receiving the memory clear command CLR1, the delaying address controller 12 clears the data written into the memory bank $4_1$ of the delay RAM 4, as will be described in detail hereinbelow. Further, the CPU 2 periodically makes a check as to whether or not the clear enable signal CLE1 is in the logical state "0" When the clear enable signal is in the logical state "0", it is judged that clearing of the memory bank $4_1$ of the delay RAM 4 has been completed, and then the muting of the output level of the effecter block EF1 is canceled, whereby the output level of the effecter block EF1 for pitch change progressively increases immediately after canceling of the muting, as shown in FIG. 9.

Next, description will be made of the operation of the delaying address controller 12 for clearing the data written in the memory bank $4_1$ of the delay RAM 4. First, when the CPU 2 delivers the memory clear command CLR1 (see FIG. 7*b*) via the CPU bus 3 to the delaying address controller 12, the differentiating circuit 17 differentiates the clear command CLR1 to deliver the differential signal DEF having the negative logic appearing in FIG. 7*c*. Then, the memory clear mode register 20 delivers the clear enable signal CLE1 in the logical state "1" (see FIG. 7*f*) in synchronism with rise of the differential signal DEF to set the operation of the delaying address controller 12 to the memory clear mode, as shown at the bottom FIG. 7*a* to FIG. 7*j*. The clear enable signal in the logical state "1" is delivered as the memory clear signal MCLR through the three-state buffer 27 when the effecter bank number EBN1 is supplied thereto. On the other hand, an output signal from the AND gate 23, i.e. the negative clear signal NCR falls in synchronism with fall of the differential signal DEF to clear the count value of the counter 24.

In the resulting state, after a predetermined time period has elapsed to complete one DAC cycle, and accordingly the last step signal LSTP is supplied to the delaying address controller 12 through the input terminal 18 thereof, and when the effecter bank number signal EBN1 (see FIG. 7*g*) corresponding to the effecter block EF1 is input to the controller 12, the selector 21, which currently is set to select the input through the input terminal B, i.e. the effecter bank number signal EBN1, by the clear enable signal CLE1 in the logical state "1", delivers the effecter bank number signal EBN1 as the counter enable signal CE to thereby enable the counting operation of the counter 24. Accordingly, the counter 24 starts the counting operation in synchronism with inputting of the clock pulses $\phi$, and the count value (equal to 0 for the first clock pulse $\phi$ after starting the memory clear) is supplied via the three-state buffer 27 to the subtracter 35 through the input terminal A thereof as the count data CD1.

Since currently the memory clear signal MCLR is in the logical state "1", the output data from the inverter 33 is in the logical state "0" to close the gate 34. On the other hand, as shown in FIG. 3*h*, from a five-staged register, not shown, the bank size BS1 is delivered to the delaying address controller 12 only over the time period corresponding to the whole steps of the effecter block EF1, i.e. the steps No. 0 to No. 55, to be processed within one DAC cycle.

Accordingly, the subtracter 35 subtracts the count data CD1 (equal to 0 for the first clock pulse $\phi$ after starting the memory clear) from the bank size BS1, and the resulting difference is input via the adder 36 to the remainder calculator 37. Then, the remainder calculator 37 performs remainder calculation on the result of subtraction by the subtracter 35 and the bank size BS1. Since the gate 34 is closed in the memory clear mode, as described above, the result of subtraction by the subtracter 35 is not larger than the bank size BS1, the output from the subtracter 35 (corresponding to the ending address (TAD2–1) of the memory bank $4_1$ of the delay RAM 4 for the first clock $\phi$ after starting the memory clear) is delivered therefrom as it is to the adder 38. The adder 38 adds up the output from the remainder calculator 37 and the starting address data TAD1 (address 0) delivered from the aforementioned starting address register for the delay RAM 4, and outputs the resulting sum as modified address data MAD.

Then, the modified address data MAD is delivered to the memory controller 13 appearing in FIG. 8. In the present case, the memory controller 13 is supplied with the memory clear signal MCLR, and accordingly, both the selectors 39 and 40 select the data of "0" input thereto via their input terminals B and supply the data of "0" to the delay RAM 4 through the data input terminal DTA and the write/read control terminal NW/R, respectively. For the first clock $\phi$ after starting the memory clear, the data of "0" is written into the ending address (TAD2–1) of the area $4_1$ of the delay RAM 4, in other words, the musical tone data of the ending address (TAD2–1) of the memory bank $4_1$ of the delay RAM 4 is cleared.

The operations described above are carried out so long as the delaying address controller 12 is supplied with the effecter bank number signal EBN1 (see FIG. 7*g* and 7*h*), to clear musical tone data stored in the total number of 56 addresses from the ending address (TAD2–1) to an address smaller by 55. When the effecter bank number signal EBN1 ceases to be supplied to the delaying address controller 12, the count enable signal CE is changed into the logical state "0", and accordingly the counter 24 stops its counting operation, whereby the memory clear operation of the signal processor is terminated.

Thereafter, one DAC cycle is completed. When the effecter bank number signal EBN1 is supplied to the delaying address controller 12 again, the counter 24 restarts its counting operation from the count value obtained immediately before termination of the memory clear operation in the immediately preceding DAC cycle in the memory clear mode of the delaying address controller 12, and hence in this new one DAC cycle for clearing operation, the musical tone data in 56 addresses are cleared from an address which is smaller than the starting address (TAD2–1) of the memory bank $4_1$ of the delay RAM 4 by 56 to an address which is smaller than the same (TAD2–1) by 111.

Thus, according to the present signal processor, during one DAC cycle, only addresses within the delay RAM 4 corresponding in number to the number of steps of a related or desired one of the effecter blocks EF1 to EF5, i.e. the addresses of the related one of the memory banks $4_1$ to $4_5$, are cleared, so that it takes several DAC cycles to clear all the data in the addresses of the delay RAM 4 corresponding to the effecter block for which the change of the sound effect is instructed.

When the count value of the counter 24 becomes equal to the bank size BS1 while the effecter bank number signal FBN1 is supplied to the delaying address controller 12 during the memory clear mode, the count value is supplied to the subtracter 35 through the input terminal A thereof as the count data CD1. The subtracter 35 subtracts the count data CD1 (equal to the bank size BS1) from the bank size BS1, and the result of subtraction (equal to 0) is supplied via the adder 36 to the remainder calculator 37. Then, the remainder calculator 37 performs the remainder calculation on the result of subtraction by the subtracter 35 (equal to 0) and the bank size BS1. In the present case, the result of subtraction by the subtracter 35 is smaller than the bank size BS1, and accordingly the output from the subtracter 35 (equal to 0) is delivered from the calculator 37 to the adder 38, as it is. The adder 38 adds up the result of the subtraction and the starting address data TAD1 delivered from the starting address register for the delay RAM 4, and delivers the resulting sum (in the present case, the starting address data TAD1) as the modified address data MAD.

Then, the modified address data MAD (starting address data TAD1) is delivered to the memory controller 13 appearing in FIG. 8. In the present case, the memory controller 13 is being supplied with the memory clear signal MCLR, so that the both the selectors 39 and 40 select the data of "0" input via their input terminals B and supply the data via the data input terminal DTA and the write/read control terminal NW/R. Therefore, the data of "0" is written into the starting address of the memory bank $4_1$ of the delay RAM 4. Thus, all the addresses of the area $4_1$ of the delay RAM 4 are cleared.

Further, when the count value of the counter 24 becomes equal to the bank size BS1, the comparator 25 outputs the equality signal EQ, as shown in FIG. 7*i*, so that the output signal from the AND gate 26 rises, i.e. changes its state from the logical state "0" to the logical state "1", and the output signal in the logical state "1" is supplied to the second input terminal of the NAND gate 22. On the other hand, the NAND gate 22 is being supplied at the first input terminal with the clear enable signal CLE1 in the logical state "1" delivered from the memory clear register 20. Accordingly, the output signal from the NAND gate 22 falls, i.e. changes its state from the logical state "1" to the logical state "0", whereby the output signal from the AND gate 23, i.e. the negative clear signal NCR, also falls, i.e. changes its state from the logical state "1" to the logical state "0", as shown in FIG. 7*d*, whereupon the count value of the counter 24 is cleared.

On the other hand, the output signal or equality signal EQ from the AND gate 26 is supplied to the clear circuit 19. The clear circuit 19 stores the equality signal EQ, and upon termination of the present DAC cycle, the clear circuit 19 will deliver the clear signal CLO in synchronism with rise of the last step signal LSTP. Accordingly, the output signal from the AND gate 23, i.e. the negative clear signal NCR also falls in synchronism with fall of the clear signal CLO as shown in FIG. 7*d*, whereupon the count value of the counter 24 is cleared.

As described hereinabove, musical tone data stored in one memory bank of the delay RAM 4 is cleared over several DAC cycles, and hence a time point at which all the musical tone data stored in all the addresses of memory bank $4_1$ is cleared, i.e. a time point at which the equality signal EQ is delivered from the comparator 25 belongs to duration of the effecter number signal EBN1 being in the logical state "1", as shown in FIG. 7*i*. If the mode of the signal processor is changed from the memory clear mode to the normal mode in which the delay RAM 4 is accessed by a microprogram, instantly upon delivery of the equality signal EQ, it can result in undesired occurrence of noise.

Therefore, according to the present embodiment, as shown in FIG. 7*a*~7*j*, even if the musical tone data of all the addresses of the memory bank $4_1$ have been actually cleared, the memory clear mode of the signal processor continues until the last step signal LSTP indicative of termination of one DAC cycle is input to the clear circuit 19 of the delaying address controller 12, whereupon the clear circuit 19 outputs the clear signal CLO, based on which the memory clear register 20 causes the clear enable signal CLE1 to fall from its logical state "1" to logical state "0", to thereby allow the mode to be changed from the memory clear mode to the normal mode at the termination of one DAC cycle.

The CPU 2, which periodically makes a check for the logical state "0" of the clear enable signal CLE1, judges that the clearing of the area of the delay RAM 4 to be cleared has been completed, when it detects the logical state "0" of the clear enable signal CLE1, canceling the muting of the output level of the related effecter block. Accordingly, the output level of the electronic musical instrument for the pitch change effect progressively rises after the cancellation.

While the above description is directed to the clearing of musical tone data in the memory bank $4_1$ of the delay RAM 4, similar clearing operations are carried out to clear musical tone data in the area $4_2$ to $4_5$ of the delay RAM 4.

Next, the operation of the delaying address controller 12 in the normal mode will be described.

In the normal mode, the memory bank address counters $16_1$ to $16_5$ serve as counters for counting addresses of the memory banks, respectively. That is, the memory bank address counters $16_1$ to $16_5$ output addresses 0 to BS1, 0 to BS2, 0 to BS3, 0 to BS4, and 0 to BS5, respectively. The total numbers of the respective addresses are equal to the respective proper bank sizes, since the bank sizes BS1 to BS5 are values which are each smaller than the proper bank sizes, by 1.

In the normal mode, the memory clear commands CLR1 to CLR5 from the CPU 2 remain in the logical state "0" (see FIG. 7*b*), so that the output (differential signal) DEF from the differentiating circuit 17 is always in the logical state "1" (see FIG. 7*c*), and the output (clear enable signal) CLE1 from the memory clear mode register 20 is in the logical state "0" as well. As a result, the selector 21 always selects and supplies the last step signal LSTP input to the terminal A as the counter enable signal CE to the counter enable input terminal CE of the counter 24. The counter 24 counts up upon rise of the clock $\phi$ when the last step signal LSTP is in the logical state "1". The clock $\phi$ rises only once when the last step signal LSTP is in the logical state "1", so that the counter 24 counts up at the end of each DAC cycle (see FIG. 7*a* and 7*j*).

The comparator 25 in the memory bank address counter $16_1$ compares the output from the counter 24 with the bank size BS1 supplied thereto on a time shared basis, and when they are equal to each other, the equality signal EQ is delivered to the one input terminal of the AND gate 26. The other input terminal of the AND gate 26 is supplied with the effecter bank number signal EBN1, so that the output from the AND gate 26 is in the logical state "1" so longs as the effecter bank number EBN1 is in the logical state "1" That is, only while the equality signal EQ is in the logical state "1" and at the same time the selected microprogram is carried out at the effecter block EF1, the output from the AND gate 26 is in the logical state "1".

The clear circuit 19 stores the logical state "1" of output from the AND gate 26 (i.e. the equality signal EQ) after the output from the AND gate 26 is in the logical state "1", as described hereinbefore, and then when the last step signal LSTP is set to the logical state "1", it delivers the clear signal CLO in the logical state "0", to thereby cause the AND gate 23 to deliver the negative clear signal NCR to the counter 24 to clear the count value thereof (see FIG. 7*d*, 7*e*, and 7*j*). The counter 24 continues to count after the count value thereof is cleared. Thus, the counter 24 repeatedly counts from 0 to BS1 in the normal mode. The memory bank address counters $16_2$ to $16_5$ also operate in the same manner.

The output from the counter 24 is delivered to the input terminal A of the subtracter 35 as the count data CD1 only while the effecter bank number signal EBN1 input to the three-state buffer 27 is in the logical state "1". Although the three-state buffer 27 in the memory bank address counter $16_1$ is set to the high-impedance state when the effecter bank number signal EBN1 is in the logical state "0", one of the other memory bank address counters $16_2$ to $16_5$ delivers a corresponding one of the count data CD2 to CD5 to the input terminal A of the subtracter 35 on a time shared basis.

The subtracter 35 subtracts the count data CD1 to CD5 from the respective bank sizes BS1 to BS5, respectively, sequentially within one DAC cycle and delivers calculation results to the adder 36. The role of the subtracter 35 is to invert the direction of change of each of the count data CD1 to CD5. That is, the direction of change from 0 toward respective BS1 to BS5 is inverted to the direction of change from BS1 to BS5 toward 0, respectively.

On the other hand, the adder 28 is supplied with the delaying address data AD and the delay address-changing data AMD to be added up thereby. The remainder calculator 29 compares the resulting sum with a corresponding one of the bank sizes BS1 to BS5. When the sum is smaller than the corresponding one of the proper bank sizes BS1' to BS5', the sum is delivered as it is, whereas when the sum is equal to or larger than same, a value of the former minus the latter is delivered therefrom. The remainder calculator 29 plays the role of preventing the address data, input thereto, from exceeding the bank size corresponding thereto.

This is because although the delaying address data AD is set in advance such that it does not exceed the correspondent bank size, the sum of the delaying address data AD and the delaying address-changing data AMD can exceed the bank size.

Similarly, the remainder calculator 37 prevents the sum of the output from the subtracter 35 and the remainder calculator 29 from exceeding the corresponding bank size. Finally, the output from the remainder calculator 37 is added up by the adder 38 with the corresponding one of the starting addresses TAD1 to TAD5 supplied thereto on a time shared basis, and the resulting modified address data MAD, which is the absolute address, is applied through the memory controller 13 to the address terminal ADS of the delay RAM 4.

In the memory controller shown in FIG. 8, the selectors 39 and 40 select signals supplied to their input terminals A, respectively, since the memory clear signal MCLR is in the logical state "0" in the normal mode. As a result, the musical tone data MTD is applied therefrom to the data input terminal DTA of the delay RAM 4, and the control code CCD read from the microprogram memory 5 is applied to the read/write control terminal NW/R of same.

As described heretofore, in the normal mode, the memory bank address counters $\mathbf{16}_1$ to $\mathbf{16}_5$ count addresses of the memory banks, respectively, during each DAC cycle. The subtracter 35 changes the direction of counting of addresses, and then each of the counted addresses is added up with a corresponding one of the starting addresses TAD1 to TAD5, by the adder 38, thereby realizing the shifting of addresses shown in FIG. 5.

The principle of sound effecting-creating operations carried out in the normal mode is a conventionally known technique, and detailed description thereof is omitted, for which reference should be made e.g. to U.S. Pat. No. 4,569,268 as to a sound effect of modulation type, such as chorus, and to U.S. Pat. No. 4,570,523 as to a sound effect of reverberation type.

According to the present embodiment, address counting for clearing selected one of the memory banks of the RAM 4 and that for use in the normal mode are both performed by the corresponding one of the memory bank address counters $\mathbf{16}_1$ to $\mathbf{16}_5$, which make it possible to prevent the size of the whole circuit configuration of the signal processor from increasing.

Further, no microprogram is used for clearing the memory, but the arrangement of hardware, i.e. the circuit configration, is made use of to this end, which makes it possible to clear the memory with little load on the CPU.

Further, an execution time period assigned to one effecter block for which a microprogram should be changed is used in clearing a correspond memory bank of the RAM 4, which makes it possible to effect the memory clear within the least possible time period.

Further, although in the above described embodiment, there are provided memory bank address counters 16 corresponding in number to the number of the effecter blocks EF1 to EF5, and the memory clear signal MCLR, etc. are generated from each of the circuits 16, this is not limitative, but a single memory bank address counter 16 may be operated on a time shared basis to sequentially generate a memory clear signal MCLR on a time shared basis.

What is claimed is:

1. A signal processor for executing a plurality of microprograms to perform delaying processing and various arithmetic computation processing of digital signals input thereto, comprising:

memory means having a storage area thereof divided into a plurality of divided areas corresponding, respectively, to said microprograms;

address control means for controlling write and read of said digital signals into and from said divided areas of said memory means;

instructing means for giving an instruction for changing at least one of said microprograms; and control means responsive to said instruction from said instruction means, for controlling said address control means to clear a specified portion of said divided areas of said memory means which may be less than all divided areas of said memory means, wherein said address control means clears said digital signals stored in said specified portion of said memory means corresponding to a microprogram to be changed without stopping execution of microprograms other than said microprogram to be changed.

2. A signal processor according to claim 1, including:

cycle termination-detecting means for detecting termination of one cycle of execution of all said microprograms, and for generating a cycle termination signal when said termination of said one cycle is detected;

a plurality of counting means provided, respectively, for said divided areas of said memory means, each of said counting means being for counting a number of addresses of a corresponding one of said divided areas from which a corresponding one of said digital signals is cleared; and memory use-permitting means for permitting use of said corresponding one divided area when the number of said addresses counted by each said counting means reaches a number corresponding to a size of said corresponding one divided area and said cycle termination signal is generated.

3. A signal processor according to claim 2, wherein said address control means includes a plurality of clear signal-generating means provided, respectively, for said divided areas of said memory means, each of said clear signal-generating means being for generating a memory clear signal over a time period during which a corresponding one of said microprograms instructed to be changed by said instructing means is executed once.

4. A signal processor according to claim 3, wherein said address control means includes data clear means responsive to said memory clear signal from each said clear signal-generating means, for writing data of a particular value into a selected address of one of said divided areas of said memory means corresponding to said corresponding one microprogram instructed to be changed by said instructing means.

5. A signal processor according to claim 1, wherein said address control means includes a plurality of clear signal-generating means provided, respectively, for clearing said specified portion of said memory means, each of said clear signal-generating means generating a memory clear signal over a time period during which a corresponding one of said microprograms instructed to be changed by said instructing means is executed once, and wherein said address control means further includes a plurality of address counting means for outputting address numbers corresponding to said specified portion of said memory means to be cleared when said clearing is executed, each of said plurality of address counting means operating as a counter used for generating a delayed signal when said clearing is not executed.

6. A signal processor according to claim 5, wherein said address control means includes data clear means responsive to said memory clear signal from each said clear signal-generating means, for writing data of a particular value into a selected address of one of said divided areas of said memory means corresponding to said corresponding one microprogram instructed to be changed by said instructing means.

7. A signal processor according to claim 5, wherein said plurality of address counting means count up faster when said clearing is executed than when said clearing is not executed.

8. A signal processor according to claim 1, including:

second memory means storing said microprograms;

starting address-designating means for designating starting addresses for said microprograms; and program-reading means for addressing said second memory means, based on said starting addresses designated by said starting address-designating means, for reading said microprograms from said second memory means.

9. A signal processor according to claim 1, wherein said address control means includes a plurality of clear signal-generating means provided, respectively, for clearing said specified portion of said memory means, each of said clear signal-generating means generating a memory clear signal over a time period during which a corresponding one of said microprograms instructed to be changed by said instructing means is executed once.

10. A signal processor for selectively executing a plurality of microprograms to perform delaying processing and various arithmetic computation processing of digital signals input thereto, comprising:

memory means having a storage area thereof divided into a plurality of divided areas corresponding, respectively, to a maximum number of microprograms which are selectable from said plurality of microprograms;

address control means for controlling write and read of said digital signals into and from said divided areas of said memory means;

instructing means for selecting at least one of said maximum number of said microprograms, and for giving an instruction for changing said selected at least one microprogram; and control means responsive to said instruction from said instruction means, for controlling said address control means to clear a specified portion of said memory means which may be less than all divided areas of said memory means, wherein said address control means clears said digital signals stored in said specified portion of said memory means corresponding to each selected microprogram without stopping execution of microprograms other than said selected at least one microprogram.

11. A signal processor for executing a plurality of microprograms to perform delaying processing and various arithmetic computation processing of digital signals input thereto, comprising:

memory means having a storage area thereof divided into a plurality of divided areas corresponding, respectively, to said microprograms;

address control means for controlling write and read of said digital signals into and from said divided areas of said memory means;

instructing means for giving an instruction for changing at least one of said microprograms;

control means responsive to said instruction from said instruction means, for controlling said address control means to clear a specified portion of said divided areas of said memory means which may be less than all divided areas of said memory means without stopping execution of microprograms other than said at least one microprogram to be changed wherein said address control means clears at least one of said digital signals stored in said specified portion of said memory means, and wherein said address control means includes a plurality of clear signal-generating means provided, respectively, for said specified portion of said memory means, each of said clear signal-generating means generating a memory clear signal over a time period during which a corresponding one of said microprograms instructed to be changed by said instructing means is executed once.

12. A signal processor for sequentially executing a plurality of different microprograms during one sampling period, comprising:

memory means having a storage area thereof divided into a plurality of divided areas corresponding, respectively, to said microprograms;

instructing means for giving an instruction for changing at least one of said microprograms;

memory clearing means responsive to said instruction from said instruction means, for clearing a specified portion of said memory means which may be less than all divided areas of said memory means, wherein said memory clearing means clears said specified portion of said memory means corresponding to a microprogram to be changed, only over a time period during which said at least one microprogram to be changed should be executed without stopping execution of microprograms other than said at least one microprogram to be changed.

13. A signal processor according to claim 12, wherein said memory clearing means executes said clearing during a plurality of sampling periods, when at least one of said divided areas of said memory means corresponding to said at least one microprogram is larger than the area which can be cleared during one sampling period.

* * * * *